US011197594B2

(12) United States Patent
Chu et al.

(10) Patent No.: US 11,197,594 B2
(45) Date of Patent: Dec. 14, 2021

(54) CLEANER

(71) Applicant: Samsung Electronics Co., Ltd., Suwon-si (KR)

(72) Inventors: Seong-Tae Chu, Hwaseong-si (KR); Byung Jo Lee, Yongin-si (KR); Dong Han Kim, Suwon-si (KR); Jeong Hee Cho, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 19 days.

(21) Appl. No.: 16/634,368

(22) PCT Filed: Jul. 18, 2018

(86) PCT No.: PCT/KR2018/008110
§ 371 (c)(1),
(2) Date: Jan. 27, 2020

(87) PCT Pub. No.: WO2019/022431
PCT Pub. Date: Jan. 31, 2019

(65) Prior Publication Data

US 2021/0093135 A1 Apr. 1, 2021

(30) Foreign Application Priority Data

Jul. 26, 2017 (KR) ..... 10-2017-0094840

(51) Int. Cl.
*A47L 9/02* (2006.01)
*A47L 5/36* (2006.01)
(Continued)

(52) U.S. Cl.
CPC ..... *A47L 9/02* (2013.01); *A47L 5/362* (2013.01); *A47L 9/062* (2013.01); *A47L 9/242* (2013.01)

(58) Field of Classification Search
CPC ..... A47L 9/02; A47L 9/242; A47L 5/362
See application file for complete search history.

(56) References Cited

U.S. PATENT DOCUMENTS 3,940,817 A * 3/1976 Levack ..... E04H 4/1636 15/1.7
4,962,559 A * 10/1990 Schuman ..... E04H 4/1618 15/1.7
(Continued)

FOREIGN PATENT DOCUMENTS

DE 19504333 A1 8/1996
KR 10-2001-0001348 U 1/2001
(Continued)

OTHER PUBLICATIONS

Korean Office Action dated Jul. 13, 2021, issued in Application No. 10-2017-0094840.
(Continued)

*Primary Examiner* — David Redding
(74) *Attorney, Agent, or Firm* — Jefferson IP Law, LLP

(57) ABSTRACT

The present disclosure relates to a cleaner improving the cleaning efficiency. The cleaner includes a main body, a suction device configured to suck foreign substances on a surface to be cleaned, and an extension member positioned in the rear of the suction device to connect the main body and the suction device, wherein the suction device includes a suction head including a suction port, a connection member connecting the suction head and the extension member, and a weight accommodated in the suction device and disposed between the suction port and the extension member such that the suction port is prevented from being lifted from the surface to be cleaned when the suction device moves along the surface to be cleaned.

14 Claims, 7 Drawing Sheets

(51) Int. Cl.
*A47L 9/24* (2006.01)
*A47L 9/06* (2006.01)

(56) References Cited

U.S. PATENT DOCUMENTS

| | | | | | |
|---|---|---|---|---|---|
| 5,983,446 | A * | 11/1999 | Hsia | A47L 9/02 | 15/354 |
| 6,123,779 | A * | 9/2000 | Conrad | A47L 5/34 | 134/21 |
| 2001/0023517 | A1* | 9/2001 | Onishi | A47L 9/02 | 15/351 |
| 2006/0005350 | A1 | 1/2006 | Kim | | |
| 2015/0265116 | A1* | 9/2015 | Genn | A47L 9/02 | 15/389 |

FOREIGN PATENT DOCUMENTS

| | | | |
|---|---|---|---|
| KR | 10-2004-0005890 | A | 1/2004 |
| KR | 10-2006-0057753 | A | 5/2006 |
| KR | 10-0922506 | B1 | 10/2009 |
| KR | 10-1414660 | B1 | 7/2014 |
| KR | 10-1659009 | B1 | 9/2016 |
| KR | 10-2016-0136360 | A | 11/2016 |

OTHER PUBLICATIONS

Korean Notice of Patent Allowance dated Oct. 5, 2021, issued in Application No. 10-2017-0094840.

* cited by examiner

CLEANER

TECHNICAL FIELD

The present disclosure relates to a cleaner, and more particularly, to a cleaner that improves cleaning efficiency.

BACKGROUND ART

A cleaner is a device that cleans a room by removing foreign substances in the room, and a vacuum cleaner may be generally used at home.

The vacuum cleaner may suck air by using the suction force of a blower and then separate foreign substances in the sucked air with a device such as a filter to keep the room clean.

The cleaner may include a main body in which a blower, a dust collector, and the like are installed, a suction device installed separately from the main body to suck dust on a floor, and an extension member connecting the main body and the suction device and provided with a handle pipe.

A user may perform cleaning while holding the handle pipe of the cleaner and moving the suction device in a direction to be cleaned. The user may clean a surface to be cleaned while moving the suction device in a state of the suction device being in close contact with the surface to be cleaned.

When the suction device performs cleaning while moving a hard surface to be cleaned, the suction device and the surface to be cleaned need to be in close contact in order to maintain a high suction force. The suction device may move smoothly in a state of being in close contact with the surface to be cleaned and may efficiently clean the surface to be cleaned with a high suction force.

However, in a case where the surface to be cleaned is a carpet, when a high suction force is maintained by having the suction device in close contact with the surface to be cleaned, the movement of the suction part may not be easy. That is, in a case of cleaning the carpet, when the suction device move along the surface to be cleaned, a lot of force may be required to the user due to the friction between the suction device and the surface to be cleaned.

Therefore, when the suction device moves, a phenomenon in which the suction device is lifted from the surface to be cleaned, which is the carpet, may occur. In particular, this phenomenon may occur more often when the suction device moves backwards.

DISCLOSURE

Technical Problem

The present disclosure is directed to providing an improved vacuum cleaner in which a separate weight is disposed in a suction device.

The present disclosure is directed to providing an improved vacuum cleaner in which a weight is disposed between a rotation shaft, which constitutes an axis to rotate a suction head, and the suction head.

The present disclosure is directed to providing an improved cleaner including a fixing member that may prevent the movement of a weight received inside a suction device.

Technical Solution

One aspect of the present disclosure provides a cleaner including a main body, a suction device configured to suck foreign substances on a surface to be cleaned, and an extension member positioned in the rear of the suction device to connect the main body and the suction device, wherein the suction device includes a suction head including a suction port, a connection member connecting the suction head and the extension member, and a weight accommodated in the suction device and disposed between the suction port and the extension member such that the suction port is prevented from being lifted from the surface to be cleaned when the suction device moves along the surface to be cleaned.

The connection member may include a first connection member connected to the suction head, a second connection member connected to the extension member, and a first rotation shaft configured to rotatably connect the first connection member and the second connection member.

The weight may be disposed between the suction port and the first rotation shaft.

The first connection member may include a second rotation shaft configured to rotatably connect the first connection member and the suction head, and the weight may be disposed between the suction port and the second rotation shaft.

The suction head may include a lower case provided with the suction port and an upper case coupled to an upper portion of the lower case, and the weight may be disposed in an inner space formed by the lower case and the upper case.

The suction head may further include a frame provided between the upper case and the lower case, and the weight may be disposed between the frame and the lower case.

The weight may include a cylindrical shape.

The transverse length of the weight may be greater than half the transverse length of the suction head.

The weight may be disposed to form bilateral symmetry inside the suction device.

The suction device may further include a fixing member configured to fix the weight.

The fixing member may include a first fixing member disposed to prevent the movement of the weight in the left and right directions, and a second fixing member disposed to prevent the movement of the weight in the up and down directions.

The fixing member may further include a third fixing member disposed to prevent the movement of the weight in the front and rear directions.

The frame may include a frame body, and a holder configured at a lower portion of the frame body to fix a friction member for floating foreign substances on the surface to be cleaned, and the first fixing member and the third fixing member may be configured in the lower case.

The second fixing member may be configured in the holder.

The weight may be disposed between the holder and the lower case.

Advantageous Effects

A suction device of the present disclosure is improved to include a separate weight disposed inside the suction device, so that when a suction head moves to clean a surface to be cleaned, a phenomenon in which a suction port is lifted from the surface to be cleaned may be prevented.

The suction device of the present disclosure is improved to include the weight disposed between the suction head and a rotation shaft constituting an axis, so that in particular, when the suction head moves backward to clean the surface to be cleaned, the phenomenon in which the suction port is lifted from the surface to be cleaned may be prevented more efficiently.

The suction device of the present disclosure is improved to include a fixing member preventing the movement of the weight received inside the suction device, so that noise that may occur when the suction head moves to clean the surface to be cleaned can be prevented.

MODE OF THE INVENTION

Figure 1:
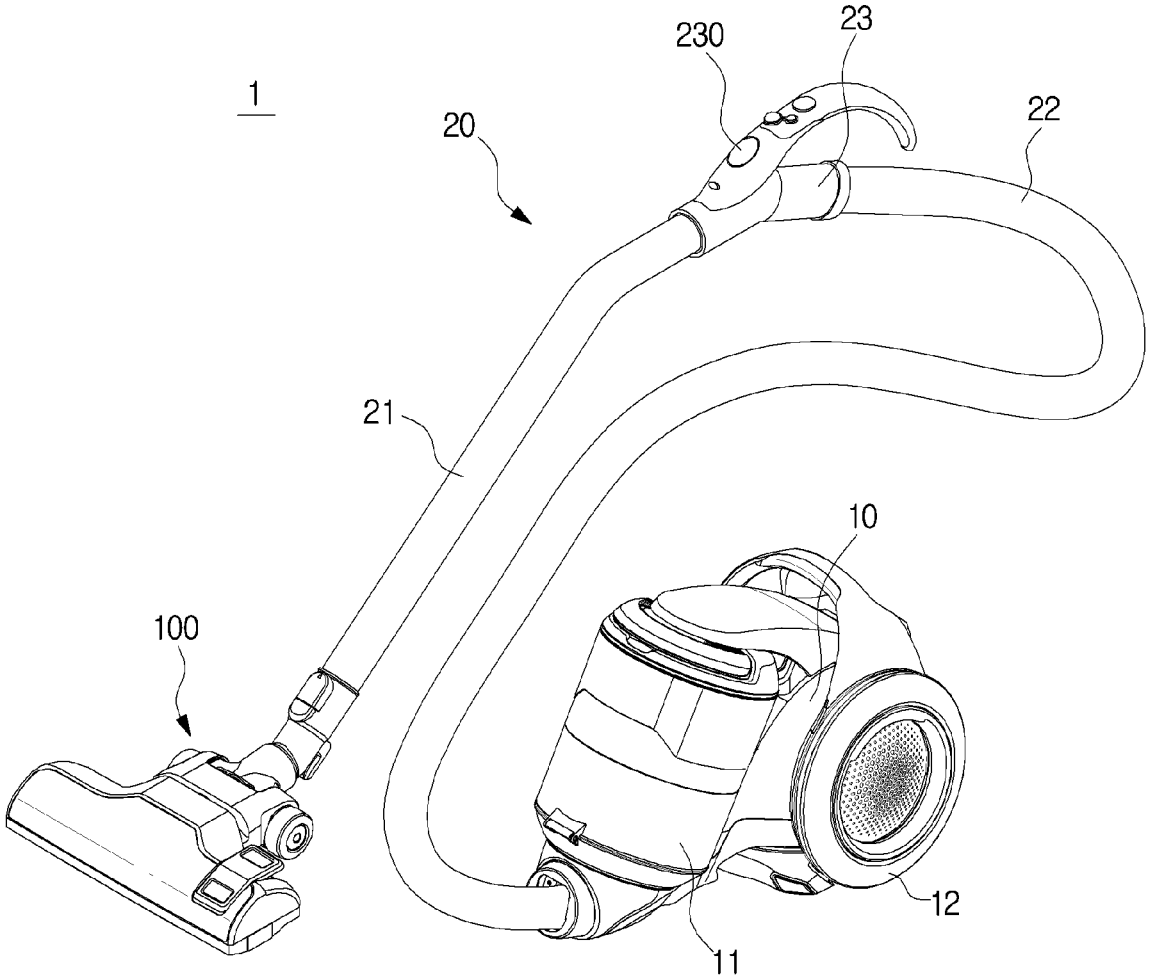
FIG. 1 is a view illustrating a cleaner according to the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions. The terms used herein are for the purpose of describing the embodiments and are not intended to restrict and/or to limit the present disclosure.

The singular expressions herein may include plural expressions, unless the context clearly dictates otherwise. The terms "comprises" and "has" are intended to indicate that there are features, numbers, steps, operations, elements, parts, or combinations thereof described in the specification.

Accordingly, the above terms do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

FIG. 1 is a view illustrating a cleaner according to the present disclosure. As illustrated in FIG. 1, a cleaner 1 according to the present disclosure may include a canister type cleaner. However, the present disclosure is not limited thereto.

For example, the cleaner 1 according to the present disclosure may include an upright type cleaner.

The cleaner 1 may include a main body 10 and a dust collecting device 11 mounted to the main body 10. The main body 10 may include main components for driving the cleaner 1, and the dust collecting device 11 may collect foreign substances sucked from a surface to be cleaned by using the cleaner 1.

The cleaner 1 may include a suction device 100 in contact with the surface to be cleaned. The suction device 100 may suck foreign substances from the surface to be cleaned.

The main body 10 may include a fan motor (not shown) for generating a suction force. The suction device 100 may suck foreign substances on the surface to be cleaned by the suction force generated by the fan motor (not shown) of the main body 10. The suction device 100 may be provided to be in close contact with the surface to be cleaned.

The main body 10 may be provided with a main wheel 12 for driving the main body 10. The main wheel 12 may be provided on opposite sides of the main body 10. The main wheel 12 may be capable of traveling in one direction.

However, the present disclosure is not limited thereto, and the number, position, and driving direction of the main wheel 12 may be variously configured within a limit in which a user may smoothly move the main body 10 when using the cleaner 1.

The main body 10 may be provided with a caster (not shown) provided to be rotatable in all directions.

The cleaner 1 may include an extension member 20 positioned in the rear of the suction device 100 to connect the main body 10 and the suction device 100. The rear of the suction device 100 may be defined as a direction from the suction device 100 toward the user when the user uses the cleaner 1.

The extension member 20 may include an extension pipe 21 made of a metal material and an extension hose 22 made of a flexible resin material.

A handle pipe 23 may be provided between the extension pipe 21 and the extension hose 22. The extension pipe 21, the handle pipe 23, and the extension hose 22 may all be provided to communicate with each other. The air sucked through the suction device 100 may sequentially pass through the extension pipe 21, the handle pipe 23, and the extension hose 22 to enter the dust collecting device 11.

The user may move the suction device 100 by holding and operating the handle pipe 23. The handle pipe 23 may be provided with an operation portion 230 that is operable to control the operation of the cleaner 1. The operation portion 230 may include a plurality of buttons, switches or dials.

The dust collecting device 11 may be a cyclone dust collecting device that generates a turning airflow to separate air and foreign substances by centrifugal force. However, the present disclosure is not limited thereto.

The air from which foreign substances are separated in the dust collecting device 11 may be discharged to the outside through a discharge port. The dust collecting device 11 may be detachably provided from the main body 10 to discard the foreign substances collected therein.

The suction device 100 may be in contact with the surface to be cleaned to suck foreign substances and air together on the surface to be cleaned. When the suction device 100 is in close contact with the surface to be cleaned, the suction device 100 may efficiently suck foreign substances on the surface to be cleaned with a strong suction force.

That is, when the suction device 100 is in close contact with the surface to be cleaned and there is no gap between the suction device 100 and the surface to be cleaned, the suction device 100 may suck foreign substances on the surface to be cleaned by using the suction force generated by the fan motor (not shown) to the maximum.

In this case, the surface to be cleaned in contact with the suction device 100 may be a hard floor or a carpet. In a case where the suction device 100 is in contact with a hard floor, such as a wooden floor, the suction device 100 can easily slide along the floor in a state of being in close contact with the floor.

That is, because the frictional force between the suction device 100 and the hard floor is relatively small, the user may move the suction device 100 with little force even when the suction device 100 is in close contact with the floor.

However, in a case where the suction device 100 is in contact with the carpet, when the suction device 100 is in close contact with the carpet, the inside of the suction device 100 becomes a state of being sealed by the suction force, and thus the suction device 100 may not easily slide along the carpet.

That is, because the frictional force between the suction device 100 and the surface to be cleaned such as a carpet is relatively high, the user may need a lot of force to move the suction device 100 while cleaning the carpet.

Therefore, when the user moves the suction device 100 to clean the surface to be cleaned, such as a carpet, a phenomenon in which the suction device 100 is lifted from the surface to be cleaned such as a carpet may occur.

Hereinafter, the structure of the suction device 100 provided in the cleaner 1 according to the present disclosure will be described in detail with reference to the accompanying drawings.

Figure 2:
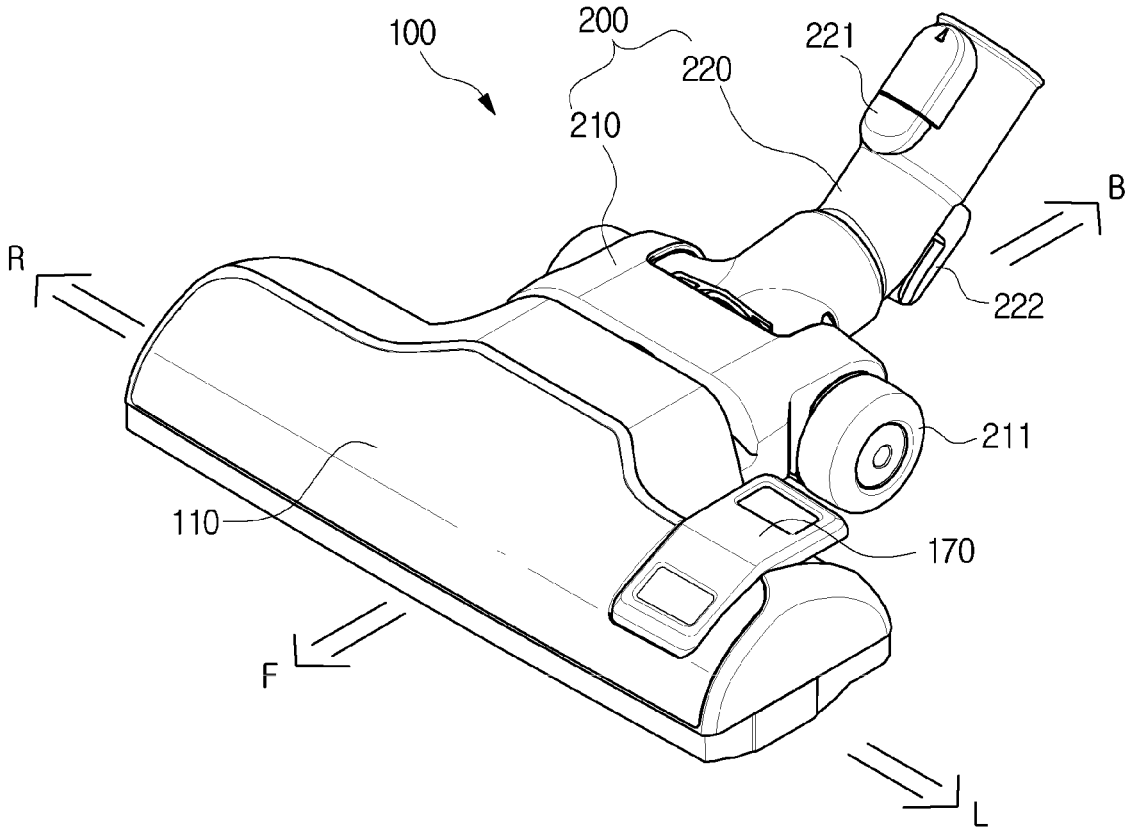
FIG. 2 is a view illustrating a suction device in the cleaner according to the present disclosure.

FIG. 2 is a view illustrating a suction device in the cleaner according to the present disclosure. As illustrated in FIG. 2, the suction device 100 according to the present disclosure may include a suction head 110 in contact with the surface to be cleaned and a connection member 200 connected to the extension pipe 21.

The suction head 110 and the connection member 200 may be pivotally connected to each other in one direction or a plurality of directions.

The connection member 200 may include a first connection member 210 connected to the suction head 110 and a second connection member 220 connected to the extension member 20.

The first connection member 210 and the second connection member 220 may be pivotally connected to each other in one direction or a plurality of directions.

The second connection member 220 may be provided with a fastening portion 221 for mounting the second connection member 220 to the extension pipe 21. The second connection member 220 may be provided with a hook portion 222 for fixing the second connection member 220 to which the extension pipe 21 is connected to a fixing portion (not shown) provided in the main body 10.

An auxiliary wheel 211 may be provided at the first connection member 210 in order to easily move the suction head 110 along the surface to be cleaned. When the suction head 110 moves along the surface to be cleaned, the auxiliary wheel 211 may travel along the floor.

The auxiliary wheel 211 may be provided at both the left and right sides of the first connection member 210. However, the present invention is not limited thereto, and the number and position of the auxiliary wheel 211 may be variously provided within a limit in which the suction head 110 may travel along the surface to be cleaned.

Due to the auxiliary wheel 211, the movement of the suction head 110 to a front F and a rear B may be relatively easy and the movement of the suction head 110 to a right R and a left L may be relatively difficult.

The suction head 110 may be provided with a button 170 to adjust a close contact force between the suction head 110 and the surface to be cleaned. The button 170 may be used to increase the cleaning efficiency depending on the nature of the surface to be cleaned. However, the present disclosure is not limited thereto, and the cleaner 1 according to the present disclosure may not include the button 170.

Figure 3:
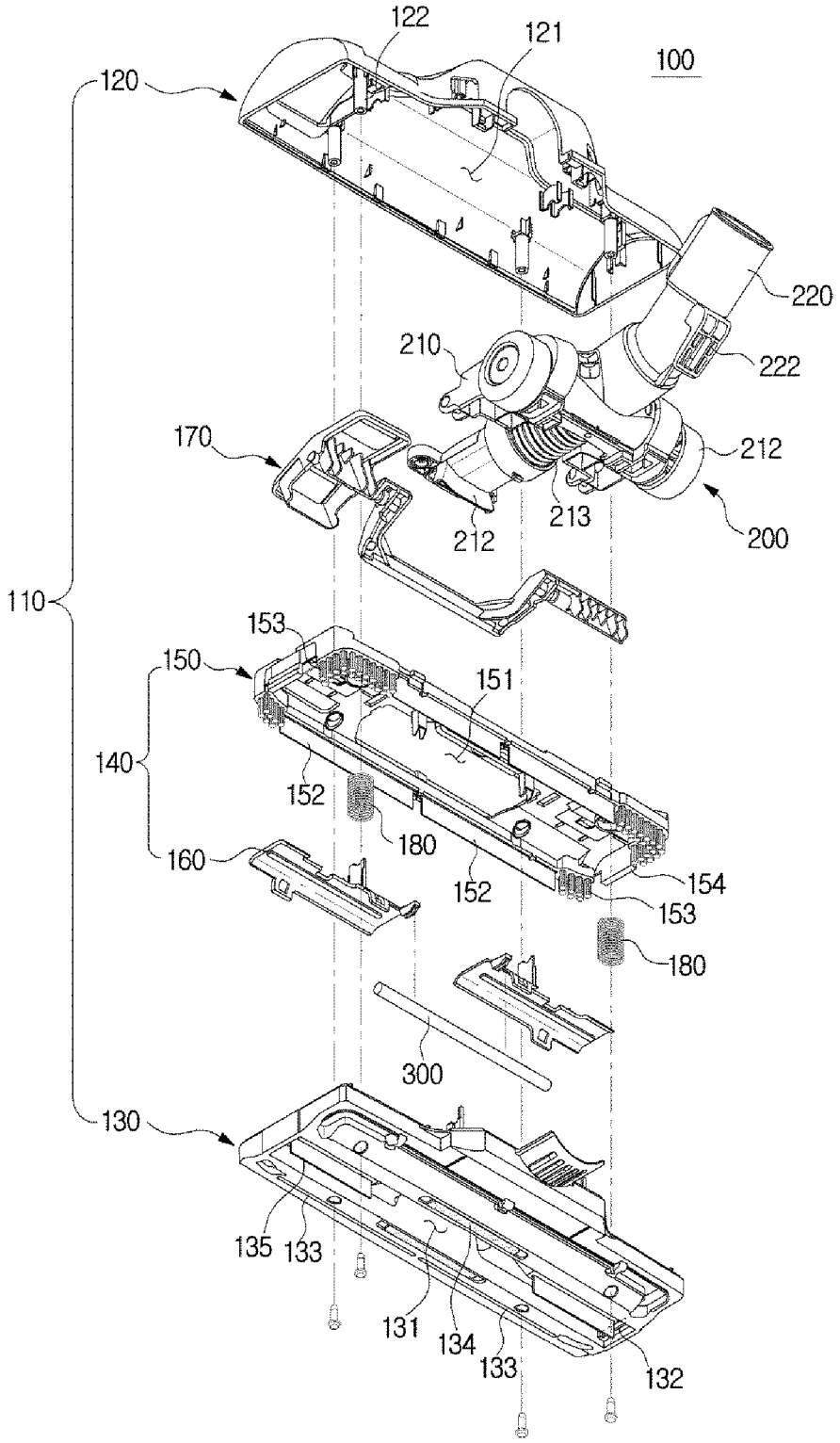
FIG. 3 is an exploded view of the suction device in the cleaner according to the present disclosure.

FIG. 3 is an exploded view of the suction device in the cleaner according to the present disclosure. As illustrated in FIG. 3, the first connection member 210 may be provided with an inlet 212 in communication with the second connection member 220.

Foreign substances on the surface to be cleaned may be sucked through a suction port 131 provided in the suction head 110 by the suction force generated in the fan motor (not shown). The sucked foreign substances may flow into the inlet 212 and may move to the dust collecting device 11 through the second connection member 220, the extension pipe 21, and the extension hose 22.

The inlet 212 and the second connection member 220 may be connected to a flexible connection hose 213. For example, the inlet 212 and the second connection member 220 may be connected to the connection hose 213 having an accordion pleat. As such, the inlet 212 and the second connection member 220 may be pivotally connected by the flexible connection hose 213.

The suction head 110 may be provided with the button 170 to adjust the close contact force between the suction head 110 and the surface to be cleaned. The user may open or close an air hole 132 provided in the suction head 110 by operating the button 170 according to the state of the floor.

The suction head 110 may include an upper case 120 and a lower case 130 coupled with the upper case 120. The upper case 120 and the lower case 130 may be coupled to each other to form an inner space 121.

The suction head 110 may include a frame 140 provided to be positioned between the upper case 120 and the lower case 130. The frame 140 may be moved to the upper case 120 side or the lower case 130 side by the operation of the button 170.

The frame 140 may include a frame body 150, and a holder 160 provided at a lower portion of the frame body 150 to fix a friction member 135 for floating foreign substances on the surface to be cleaned.

The frame body 150 may be provided with a suction portion 151 communicating with the suction port 131.

The foreign substances sucked through the suction port 131 provided in the suction head 110 by the suction force generated in the fan motor (not shown) may be introduced into the suction portion 151 and the inlet 212 and may move to the dust collecting device 11 through the second connection member 220, the extension pipe 21 and the extension hose 22.

A blade 152 for preventing the suction force of the fan motor (not shown) from being lost may be provided to protrude from one surface of the frame body 150. The blade 152 may be provided to extend toward the lower case 130 when the frame 140 is accommodated in the inner space 121 formed by the upper case 120 and the lower case 130.

The blade 152 may be provided along an outer circumference of the frame body 150. For example, the blade 152 may be provided to extend along the outer circumferences facing each other with respect to the suction portion 151. A plurality of the blades 152 may be provided to extend along the outer circumference of the frame body 150.

A brush 153 may be provided on one surface of the frame body 150. The brush 153 may be provided to extend in the same direction as the blade 152.

That is, when the frame 140 is accommodated in the inner space 121 formed by the upper case 120 and the lower case 130, the brush 153 may be provided to protrude toward the lower case 130. The brush 153 may be provided at an outer edge portion of the frame body 150.

The brush 153 and the blade 152 may be located along the outer circumference of one surface of the frame body 150. The blade 152 may extend along the circumferences of the front F and the rear B of the frame body 150.

The brush 153 may be provided at an edge side of the front F or rear B of the frame body 150. The brush 153 and the blade 152 may be provided to have the same height from one surface of the frame body 150.

Because the brush 153 and the blade 152 bring into close contact with the surface to be cleaned when the frame 140 is moved to the lower case 130 side by the button 170, a loss of suction force between the surface to be cleaned and the suction head 110 may be minimized.

The frame 140 is provided to be movable in the upper case 120 and the lower case 130 and thus may open and close the air hole 132 formed in the lower case 130.

For example, the frame body 150 may be provided with a protrusion 154 that may open and close the air hole 132 formed in the lower case 130. The protrusion 154 may be provided to extend along the outer circumference of the frame body 150 to correspond to the position of the air hole 132.

The protrusions 154 may be provided at left and right sides of one surface of the frame body 150, respectively. However, the present disclosure is not limited thereto, and the protrusion 154 and the air hole 132 may be formed at various positions.

The suction port 131 may be formed in the lower case 130. The suction port 131 may be positioned at the center of the lower case 130. The lower case 130 may be provided with a stepped portion extending in the left and right directions (L and R directions).

An outer circumference of the lower case 130 may be provided with an insertion hole 133 for inserting the brush 153 and the blade 152 provided in the frame body 150.

The insertion hole 133 may be formed at an outer edge side of the lower case 130 to correspond to the brush 153. The insertion hole 133 may be provided to extend along an outer circumference of the front and rear directions F and B of the lower case 130 to correspond to the blade 152.

The lower case 130 may be provided with a cleaning portion 134 provided to be in contact with the surface to be cleaned. The cleaning portion 134 may be positioned in the front and rear directions F and B of the lower case 130 based on the suction port 131.

The cleaning portion 134 may be a fabric having hairs of a relatively short length. The hairs provided on the cleaning portion 134 may be provided to extend diagonally.

Specifically, the hairs formed on the cleaning portion 134 positioned at the front F of the lower case 130 may be provided to extend to the rear B, and the hairs formed on the cleaning portion 134 positioned at the rear B of the lower case 130 may be provided to extend to the front F.

The cleaning portion 134 may bring into contact with the surface to be cleaned, such as a carpet, and interfere with foreign substances, such as the fur of an animal located on the surface to be cleaned, which are attached to the surface to be cleaned and are not easily removed, to remove foreign substances from the surface to be cleaned. The foreign substances removed from the surface to be cleaned may be sucked into the suction port 131 by the suction force of the fan motor (not shown).

The lower case 130 may be provided with the friction member 135 formed of a flexible material such as rubber. When the suction head 110 moves along the carpet, the friction member 135 may be rubbed with the carpet to float foreign substances present in the carpet.

The floated foreign substances may be sucked through the suction port 131. By the friction member 135, the foreign substances present in the carpet may be easily removed.

The air hole 132 may be formed at one side of the lower case 130. The air hole 132 may be opened and closed by the frame 140 according to the operation of the button 170. Specifically, the air hole 132 may be opened and closed by the protrusion 154 provided on the frame body 150.

The upper case 120 and the lower case 130 may form the inner space 121 in which the frame 140 may be accommodated. A mounting portion 122 on which an elastic member 180 is mounted may be provided on a lower surface of the upper case 120.

The mounting portion 122 may protrude from the lower surface of the upper case 120. The elastic member 180 may be mounted to the mounting portion 122 to provide an elastic force for pushing the frame 140 toward the upper case 120.

In a case where the surface to be cleaned is a hard floor, the user may press the button 170 to close the air hole 132. In a case where the surface to be cleaned is a hard floor such as a wooden floor, when the air hole 132 is opened, a loss of suction force by the fan motor (not shown) may occur.

Therefore, in order to prevent the loss of suction force, when the surface to be cleaned is a hard floor, the cleaning may be performed in a state where the air hole 132 is closed.

In this case, the frame 140 is moved to a lower portion, and the brush 153 and the blade 152 provided in the frame body 150 may protrude from the lower surface of the lower case 130. Thus, the brush 153 may sweep the floor.

In order to prevent the suction force of the fan motor (not shown) from being lost by the protruding brush 153, the blade 152 may serve to seal a space between the lower case 130 and the floor.

The friction member 135 provided in the lower case 130 may be rubbed with the carpet to float foreign substances placed in the carpet.

When the suction force is generated by the fan motor (not shown), foreign substances and air are sucked in and are introduced through the inlet 212 and then are discharged to the dust collecting device 11 through the second connection member 220, the extension pipe 21, and the extension hose 22.

As such, when a hard floor is cleaned, the air hole 132 may be provided to be closed to prevent the cleaning efficiency from being lowered.

When the surface to be cleaned is a carpet, the user may press the button 170 to open the air hole 132. The frame 140 is moved to an upper portion so that the blade 152 and the brush 153 may be inserted into the inner space of the suction head 110. The lower case 130 may be in contact with the carpet, which is the surface to be cleaned.

In general, when the suction port 131 is in close contact with the surface to be cleaned, such as a carpet, the suction port 131 and the surface to be cleaned may form a closed space, which may make it difficult to move the suction port 131. That is, a large force may be required to move the suction head 110 along the surface to be cleaned.

However, even when the surface to be cleaned is a carpet, the space formed by the surface to be cleaned and the suction head 110 may not be sealed by opening the air hole 132 on one side of the suction head 110. Therefore, the user may perform the cleaning while easily moving the suction head 110 along the carpet with a small force.

Therefore, the cleaner 1 may include the air hole 132 provided in the suction device 100 to be opened and closed according to the state of the surface to be cleaned.

That is, when cleaning the surface to be cleaned such as carpet, the air hole 132 may be opened to improve the mobility of the suction device 100, when cleaning the surface of a hard material to be cleaned such as a wooden floor, the air hole 132 may be closed to prevent the suction force of the fan motor (not shown) from being lost.

However, because the frictional force between the suction head 110 and the surface to be cleaned is relatively high when the surface to be cleaned, such as a carpet, is cleaned, a phenomenon in which the suction port 131 is lifted from the surface to be cleaned may occur when the suction head 110 moves along the surface to be cleaned.

As a result, the sealing between the suction port 131 of the suction head 110 and the surface to be cleaned may be broken. In particular, this phenomenon may occur remarkably when the suction head 110 moves to the rear B.

The cleaner 1 may include a weight 300 accommodated inside the suction device 100 to prevent the suction port 131 from lifting from the surface to be cleaned when the suction device 100 moves along the surface to be cleaned.

The weight 300 may provide an additional weight to the suction head 110.

The weight 300 may be disposed between the suction port 131 and the extension member 20. That is, the weight 300 may be provided to be disposed in the rear B from the suction port 131.

As a result, a lifting phenomenon of the suction head 1130 from the surface to be cleaned, which may occur when the suction head 110 moves from the surface to be cleaned, such as carpet, to the rear B may be prevented.

The weight 300 may include a cylindrical shape. However, the present disclosure is not limited thereto, and the weight 300 may be provided in various shapes within a limit in which the suction device 100 may be prevented from being lifted from the surface to be cleaned when the suction device 100 moves along the surface to be cleaned.

For example, the cross section of the weight 300 may include an elliptical shape, a square shape, a polygonal shape, or the like, which is not a circular shape. However, when the cross section of the weight 300 includes a circular shape, ease of processing may be secured and material costs may be further reduced.

The weight 300 may have a weight of about 45 g, but is not limited thereto.

Figure 4:
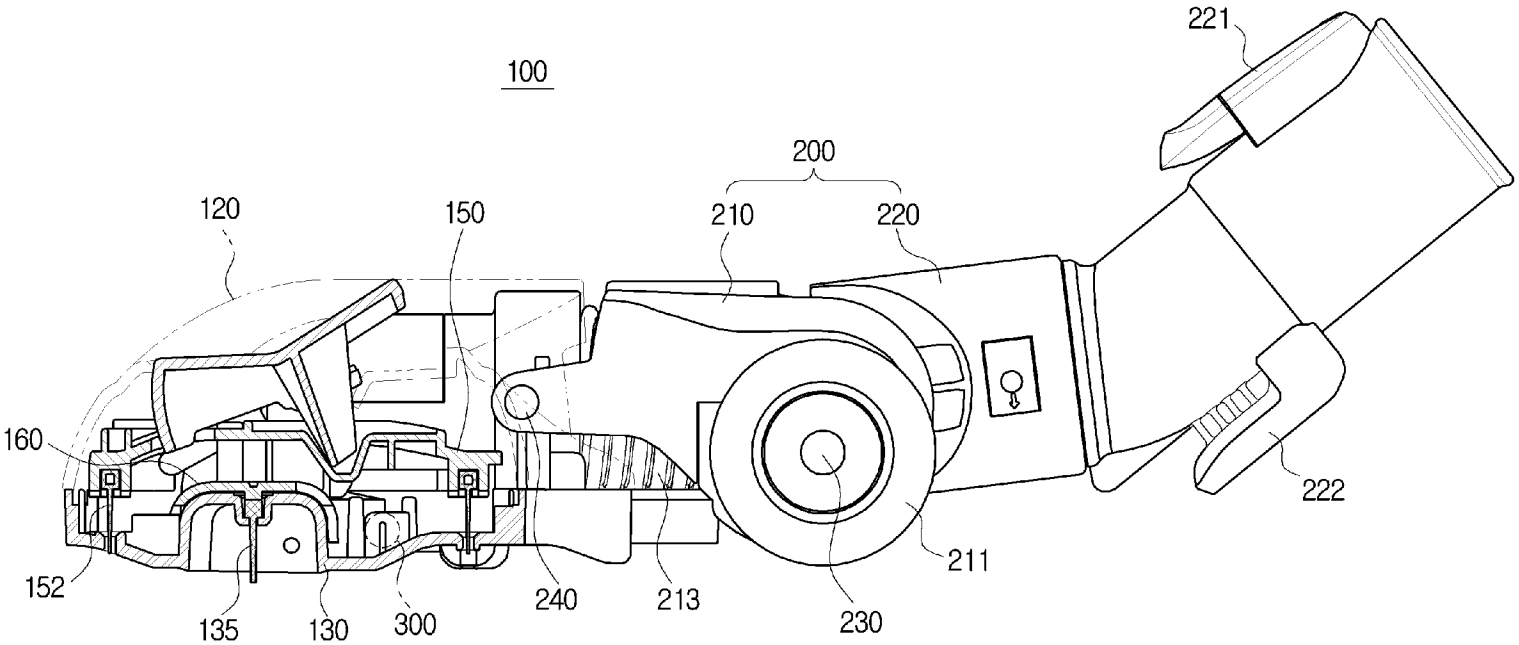
FIG. 4 is a cross-sectional view illustrating a side surface of the suction device of the cleaner according to the present disclosure.

FIG. 4 is a cross-sectional view illustrating a side surface of the suction device of the cleaner according to the present disclosure. As illustrated in FIG. 4, the connection member 200 may include a first rotation shaft 230 configured to rotatably connect the first connection member 210 and the second connection member 220.

The first connection member 210 and the second connection member 220 may be pivotally connected by the first rotation shaft 230.

The first rotation shaft 230 may form an axis such that the auxiliary wheel 211, which is provided to move the suction head 110 along the surface to be cleaned, may rotate.

When the user moves the suction device 100 along the surface to be cleaned, the phenomenon in which the suction device 100 is lifted from the surface to be cleaned may occur frequently on the first rotation shaft 230.

The weight 300 may be disposed between the suction port 131 and the first rotation shaft 230. Therefore, the lifting phenomenon of the first rotation shaft 230 may be prevented by the arrangement of the weight 300.

The first connection member 210 may include a second rotation shaft 240 configured to rotatably connect the first connection member 210 and the suction head 110.

The suction head 110 and the first connection member 210 may be pivotally connected by the second rotation shaft 240. The second rotation shaft 240 may form an axis so that the suction head 110 may rotate.

When the user moves the suction device 100 along the surface to be cleaned, the phenomenon in which the suction device 100 is lifted from the surface to be cleaned may occur frequently on the second rotation shaft 240.

The weight 300 may be disposed between the suction port 131 and the second rotation shaft 240. Therefore, the lifting phenomenon of the second rotation shaft 240 may be prevented by the arrangement of the weight 300.

The weight 300 may be disposed inside the suction head 110. The weight 300 may be disposed in the inner space 121 formed by the upper case 120 and the lower case 130.

The weight 300 may be disposed between the frame body 150 and the lower case 130. The weight 300 may be disposed between the holder 160 and the lower case 130. However, the present disclosure is not limited thereto.

Figure 5:
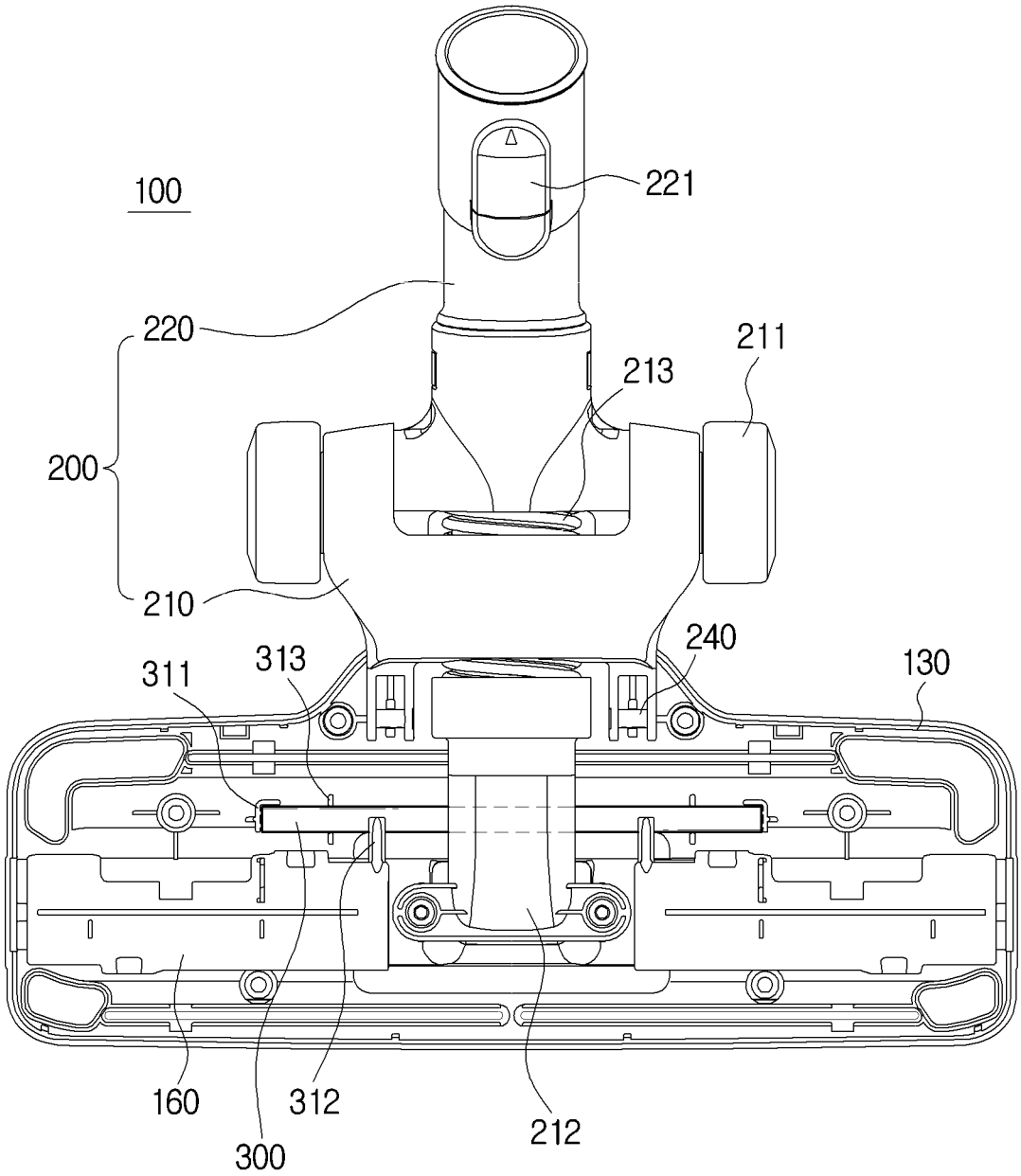
FIG. 5 is a view illustrating a weight disposed on a lower case in the cleaner according to the present disclosure.

FIG. 5 is a view illustrating a weight disposed on a lower case in the cleaner according to the present disclosure. As illustrated in FIG. 5, the weight 300 may include a shape elongated in a transverse direction.

When the transverse length of the weight 300 is short, bending may occur at opposite ends of the suction head 110, and when the user moves the suction head 110 along the surface to be cleaned, which is a carpet, with the suction device 100, lifting in the left and right directions may occur due to the bending, which may lower the cleaning efficiency.

The transverse length of the weight 300 may be greater than at least half of the transverse length of the suction head 110. However, the present disclosure is not limited thereto, and the length of the weight 300 may be variously provided within a limit in which the lifting of the suction head 110 in the left and right directions when the user cleans the surface to be cleaned, which is a carpet, with the suction device 100 may be prevented.

The weight 300 may be disposed to form bilateral symmetry inside the suction device 100.

The suction device 100 may include a fixing member 310 configured to fix the weight 300.

In a case where the weight 300 disposed inside the suction device 100 is not fixed when the user moves the suction device 100 to clean foreign substances on the surface to be cleaned, noise may occur due to the movement of the weight 300, but the fixing member 310 may prevent the noise by fixing the weight 300.

The fixing member 310 may include a first fixing member 311 disposed to prevent the movement of the weight 300 in the left and right directions and a second fixing member 312 disposed to prevent the movement of the weight 300 in the up and down directions.

The fixing member 310 may further include a third fixing member 313 disposed to prevent the movement of the weight 300 in the front and rear directions.

However, the present invention is not limited thereto, and the number of the fixing members 310 may be variously provided within a limit in which the noise generated when the user moves the suction device 100 along the surface to be cleaned may be prevented by fixing the fixing member 310.

Figure 6:
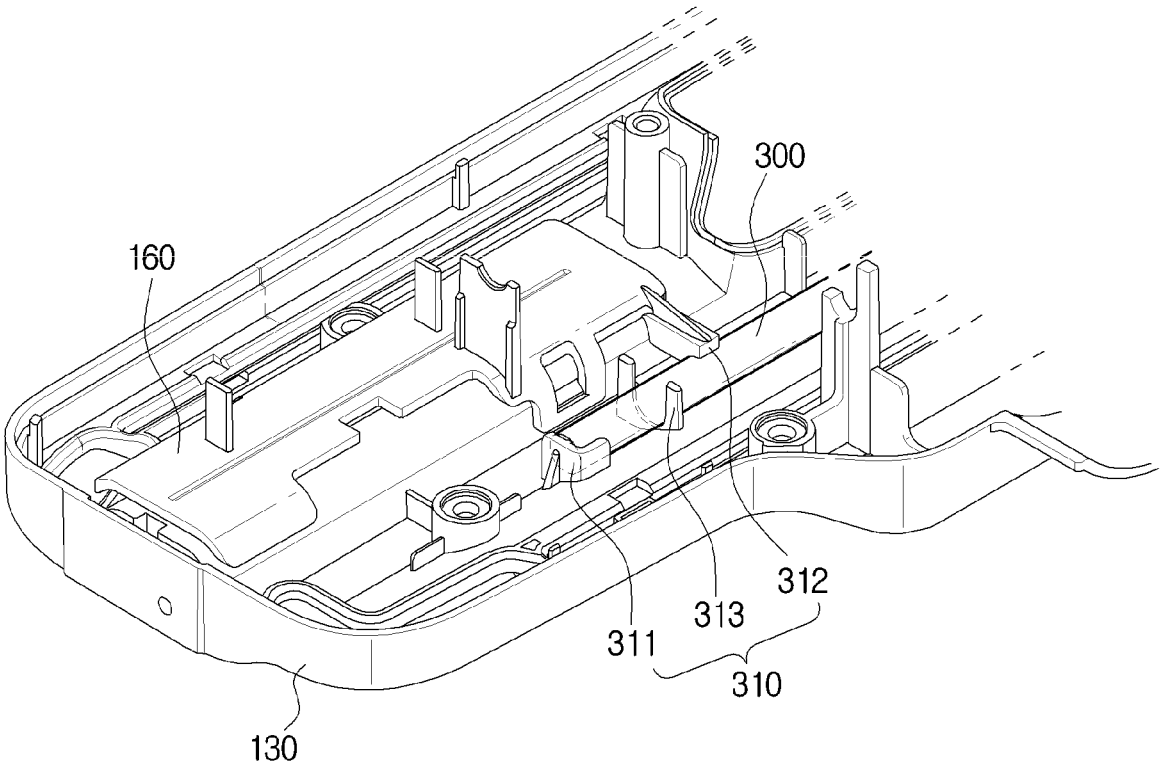
FIG. 6 is a view illustrating a fixing member for fixing the weight in the cleaner according to the present disclosure.

FIG. 6 is a view illustrating a fixing member for fixing the weight in the cleaner according to the present disclosure. As illustrated in FIG. 6, the first fixing member 311 and the third fixing member 313 may be provided in the lower case 130.

The second fixing member 312 may be provided in the holder 160. However, the present disclosure is not limited thereto, and the position of the fixing member 310 may be variously provided within a limit in which the weight 300 may be fixed to the inside of the suction head 110.

The first fixing member 311 capable of preventing the movement of the weight 300 in the left and right directions may be formed in the shape of '∟.' However, the present disclosure is not limited thereto, and the shape of the first fixing member 311 may be variously provided within a limit in which the movement of the weight 300 in the left and right directions may be prevented.

Figure 7:
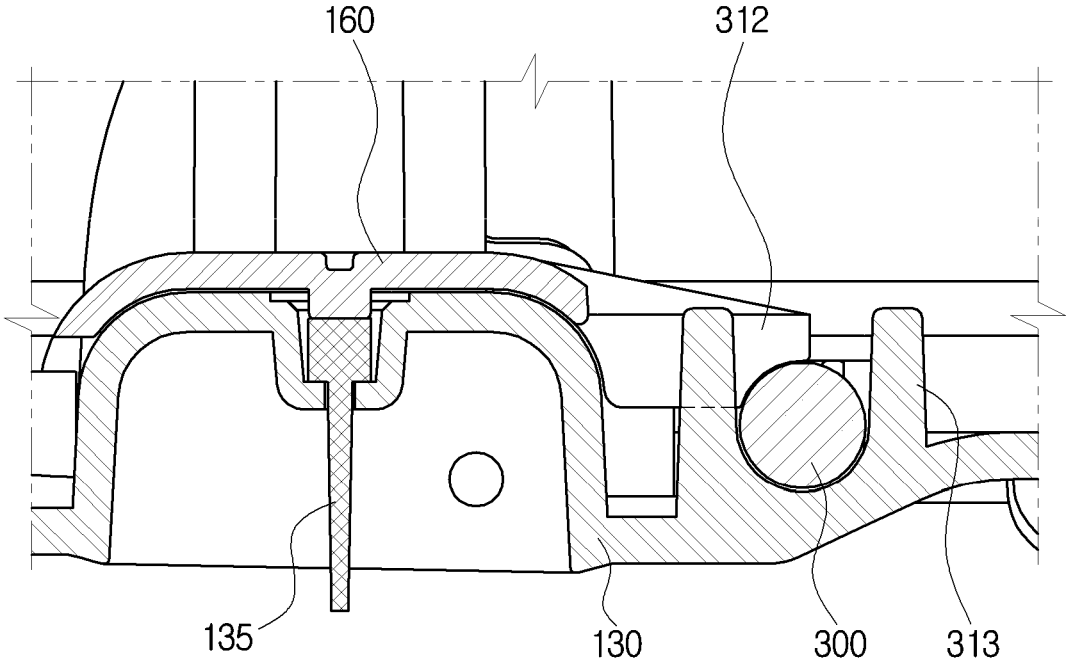
FIG. 7 is a cross-sectional view illustrating a side surface of the fixing member in the cleaner according to the present disclosure.

For example, the first fixing member 311 may include a shape of '1,' '¬' or '⊏':

FIG. 7 is a cross-sectional view illustrating a side surface of the fixing member in the cleaner according to the present disclosure. As illustrated in FIG. 6, the second fixing member 312 may extend from one end of the holder 160.

The second fixing member 312 may include a shape corresponding to a portion of the weight 300. However, the present disclosure is not limited thereto, and the shape of the second fixing member 312 may be variously provided within a limit in which the movement of the weight 300 in the up and down directions may be prevented.

For example, the first fixing member 311 may include a shape of '1.'

The third fixing member 313 may include a shape corresponding to a portion of the weight 300. However, the present disclosure is not limited thereto, and the shape of the third fixing member 313 may be variously provided within a limit in which the movement of the weight 300 in the front and rear directions may be prevented.

For example, the first fixing member 311 may include a shape of 'U.'

The technical spirit of the present disclosure has been described above, but the scope of the present disclosure is not limited thereto. It will be understood by those of skilled in the art that various changes in form and details may be made without departing from the spirit and scope of the present disclosure.

The invention claimed is:

1. A cleaner comprising:

a main body;

a suction device configured to suck foreign substances on a surface to be cleaned; and an extension member connecting the main body and the suction device, to be positioned in the rear of the suction device, wherein the suction device includes a suction head including a suction port, a connection member connecting the suction head and the extension member, and a weight accommodated in the suction device and disposed between the suction port and the extension member at the rear of the suction port such that the suction port is prevented from being lifted from the surface to be cleaned when the suction device moves along the surface to be cleaned and wherein the connection member includes: a first connection member connected to the suction head, a second connection member connected to the extension member, and a first rotation shaft configured to rotatably connect the first connection member and the second connection member.

2. The cleaner according to claim 1, wherein the weight is disposed between the suction port and the first rotation shaft.

3. The cleaner according to claim 1, wherein the first connection member includes a second rotation shaft configured to rotatably connect the first connection member and the suction head, and wherein the weight is disposed between the suction port and the second rotation shaft.

4. The cleaner according to claim 1, wherein the suction head includes a lower case provided with the suction port and an upper case coupled to an upper portion of the lower case, and wherein the weight is disposed in an inner space formed by the lower case and the upper case.

5. The cleaner according to claim 4, wherein the suction head further includes a frame provided between the upper case and the lower case, and wherein the weight is disposed between the frame and the lower case.

6. The cleaner according to claim 1, wherein the weight includes a cylindrical shape.

7. The cleaner according to claim 1, wherein the transverse length of the weight is greater than half the transverse length of the suction head.

8. The cleaner according to claim 1, wherein the weight is disposed to form bilateral symmetry inside the suction device.

9. The cleaner according to claim 5, wherein the suction device further includes a fixing member configured to fix the weight.

10. The cleaner according to claim 9, wherein the fixing member includes a first fixing member disposed to prevent the movement of the weight in the left and right directions, and a second fixing member disposed to prevent the movement of the weight in the up and down directions.

11. The cleaner according to claim 10, wherein the fixing member further includes a third fixing member disposed to prevent the movement of the weight in the front and rear directions.

12. The cleaner according to claim 11, wherein the frame includes a frame body, and a holder configured at a lower portion of the frame body to fix a friction member for floating foreign substances on the surface to be cleaned, and wherein the first fixing member and the third fixing member are configured in the lower case.

13. The cleaner according to claim 12, wherein the second fixing member is configured in the holder.

14. The cleaner according to claim 12, wherein the weight is disposed between the holder and the lower case.

* * * * *